United States Patent [19]

Wheeler

[11] Patent Number: 4,473,100

[45] Date of Patent: Sep. 25, 1984

[54] WEATHER BOARD CLAMPING DEVICE

[76] Inventor: Wallace T. Wheeler, 1951 N. 20th St., Bismarck, N. Dak. 58501

[21] Appl. No.: 493,343

[22] Filed: May 10, 1983

[51] Int. Cl.[3] ..... B23Q 3/00

[52] U.S. Cl. ..... 145/1 B; 33/187

[58] Field of Search ..... 33/187, 188; 145/1 A, 145/1 B

[56] References Cited

U.S. PATENT DOCUMENTS

| | | | |
|---|---|---|---|
| 91,683 | 6/1869 | Spaulding et al. | 145/1 A |
| 298,682 | 5/1884 | Finch | 33/187 |
| 1,115,202 | 10/1914 | Ingles | 33/187 |
| 4,159,029 | 6/1979 | Matthews | 145/1 B |

OTHER PUBLICATIONS

Popular Science, Jun. 1983 issue, p. 92.

*Primary Examiner*—Frederick R. Schmidt
*Assistant Examiner*—J. T. Zatarga

[57] ABSTRACT

A clamping device for aiding a carpenter in applying weather boards to a building. The clamping device includes: (1) a first, long, flat member terminating in a "hook"; (2) a second, longer, flat member pivotally connected by a hinge to the first member near the end opposite the "hook," and the second member normally being disposed parallel to the first member; (3) an "L"-shaped bracket which is adjustably secured to the second member; and (4) a guide rotatably connected to the second member below the hinge for abutting the first member. This device enables a single carpenter to install weather boards onto a building by placing the "hooked" first member over a board already nailed to a building. Then, the "L"-shaped bracket is adjusted to the correct board overlap dimension, and a similar device at the opposite end of the board is set at the corresponding board overlap dimension. The bottom of a new board to be nailed is then placed in each device to be supported by the respective "L"-shaped brackets and is nailed in place. The carpenter then simultaneously squeezes a rotatable guide at the bottom of the device and pulls a knob on the second member to allow the top of the device to open and remove the adjustable "L"-shaped bracket from supporting relation with the bottom of the newly nailed board. This allows each device to be lifted upwardly off of the earlier nailed board and then downwardly out from under the newly secured board, ready to be used again.

4 Claims, 4 Drawing Figures

WEATHER BOARD CLAMPING DEVICE

BACKGROUND OF THE INVENTION

This invention relates to a carpenter's tool, and more particularly to a clamping device which aids a carpenter in applying weather boards or siding to a building.

The basic principle underlying a weather boarding clamping device is that a board already nailed to a building may be used to support a new board ready to be nailed in place above it, and so on.

Several different types of weather board clamping devices used to aid a carpenter in applying weather boards or siding to a building while maintaining a preferred board overlap dimension for the boards are known. For example, each of the following prior art patents generally discloses a relatively rigid device which is clamped to or abuts the *bottom* and/or *lower sides* of a board already nailed to a building.

| U.S. Pat. No. | Inventor | Issued |
|---|---|---|
| 221,732 | Hobbs | 11/18/1879 |
| 216,252 | Allison | 6/10/1879 |
| 285,137 | Kennedy | 9/18/1883 |
| 418,754 | Schill | 1/7/1890 |
| 631,315 | Meskill | 8/22/1899 |
| 774,114 | Spear | 11/1/1904 |
| 1,598,986 | Ping | 9/7/1926 |
| 4,155,175 | Stiles | 5/22/1979 |

Alternatively, relatively recent U.S. Pat. No. 4,208,799, issued to Frantello, discloses a non-adjustable, one-piece clamp for installing weather boards, which "hooks" the *top* and both *upper sides* of the board already in place and supports the bottom and lower sides of a new board ready to be nailed. The Frantello device comprises a pair of joined J-shaped members, with one inverted relative to the other. Removing the Frantello device after nailing the new board apparently requires the device to be moved to the end of the board, because the part of the clamp abutting the bottom of the newly nailed board prevents upward movement of the clamp for removal. Of course, moving the device to the end of the board is time consuming for the carpenter.

An "adjustable" clamp with a type of "hook" attached to a board already nailed in place is disclosed in U.S. Pat. No. 368,574, issued to Eby. The Eby '574 patent teaches a weather board clamp employing an "L"-shaped slidable member connected to a hook-shaped member by an adjustable wing nut and screw. The hook-shaped member, apparently, is intended either to be "spiked" into the top of the board already in place or to be extended over the *top* and *both sides* of the board already in place. The "L"-shaped slidable member is intended to abut the bottom and outer side of a board ready to be nailed. The clamp, once in place, allows a board to be supported while it is being fitted into position to determine where the board should be cut. This clamp avoided the practice common at the time this invention was made of temporarily nailing the board to the building while measuring it. Once the correct length is found and the board is cut, the board is apparently hand-held by several carpenters and nailed in place.

As with the Frantello device, since the Eby clamp's "L"-shaped member abuts the bottom of the newly secured board, upward removal of the clamp is made difficult. Thus, the device must be moved to the end of the board and slipped off for removal. Alternatively, the clamp could be removed by disassembling the clamp so that the "L"-shaped slidable member could be moved away from the bottom of the newly secured board and thus, the hook-shaped member could be moved upwardly off of the first secured board. However, either alternative consumes time, is awkward and is generally inefficient.

Although the prior art described above eliminates some of the problems experienced by carpenters installing weather boards, the prior art still does not teach a weather boarding device capable of enabling a single carpenter to quickly and easily install the boards onto the building, while maintaining accurate board overlap dimensions set by the carpenter, which, of course, saves time and money.

SUMMARY OF THE INVENTION

Accordingly, it is an object of the present invention to provide a tool allowing one carpenter to install weather boards.

It is another object of the present invention to provide a weather board clamping device which accurately maintains the board overlap dimension set by the carpenter.

It is another object of the present invention to provide an adjustable weather board clamping device which is relatively small, is lightweight, has relatively few parts, and is inexpensive to make.

Finally, it is an object of the present invention to provide an adjustable weather board clamping device which is quick and easy to use and remove by one carpenter.

To achieve the foregoing and other objects of the invention and in accordance with the purpose of the invention, there is provided a clamping device for aiding a carpenter in applying weather boards to a building. As embodied herein, the device has four major structural features, i.e.: (1) a first, long, flat member terminating in a "hook"; (2) a second, usually longer flat member normally arranged substantially parallel to the first member and connected by a hinge to the first member near the end opposite the "hook"; (3) an adjustable bracket with a first leg being adjustably secured to the second member by a knob, bolt, washer and nut combination and a second leg abutting the first member; and (4) a rotatable guide connected to the second member below the hinge for abutting a stop on the first piece.

The device enables a single carpenter to install the boards onto a building by placing the "hook" of the first member over the *top* and *upper sides* of a board already nailed to a building. Then, the adjustable bracket is adjusted to the standard board overlap dimension for all the boards. A similar device is positioned at the opposite end of the secured board and is also set at the standard board overlap dimension. The bottom of a new board is then positioned on the adjustable brackets of the devices and the carpenter nails the board in place. The carpenter then presses downwardly on the rotatable guide at the bottom of one device and simultaneously pulls the knob away from the building to allow the bottom of the second member to hinge toward the bottom of the first member. Accordingly, the tops of the first and second members also move away from each other due to the hinge. When the top of the device separates, the first leg of the adjustable bracket is removed from abutment with the first member and clears the bottom of the newly secured board. This allows the hook of the device to be moved upwardly off of the top of the lower board and away from the building. The second clamping device is similarly removed. These clamping devices may then be placed on the top of the newly secured board to support another new board, and so on.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Figure 1:
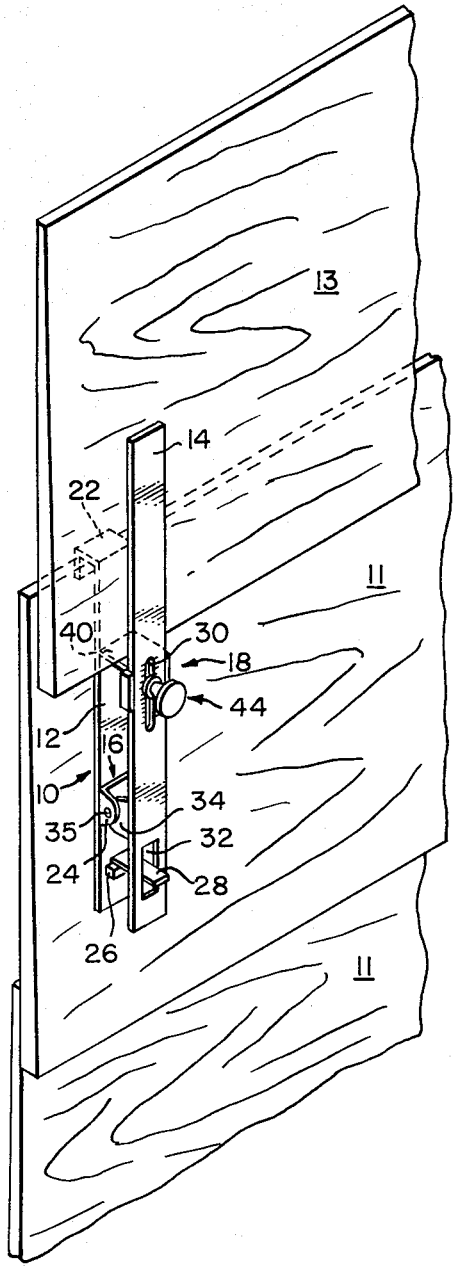
FIG. 1 is a perspective view of the weather board clamping device according to the present invention, illustrating particularly use of the device on a weather board already nailed in place to support a new board to be nailed.
Figure 2:
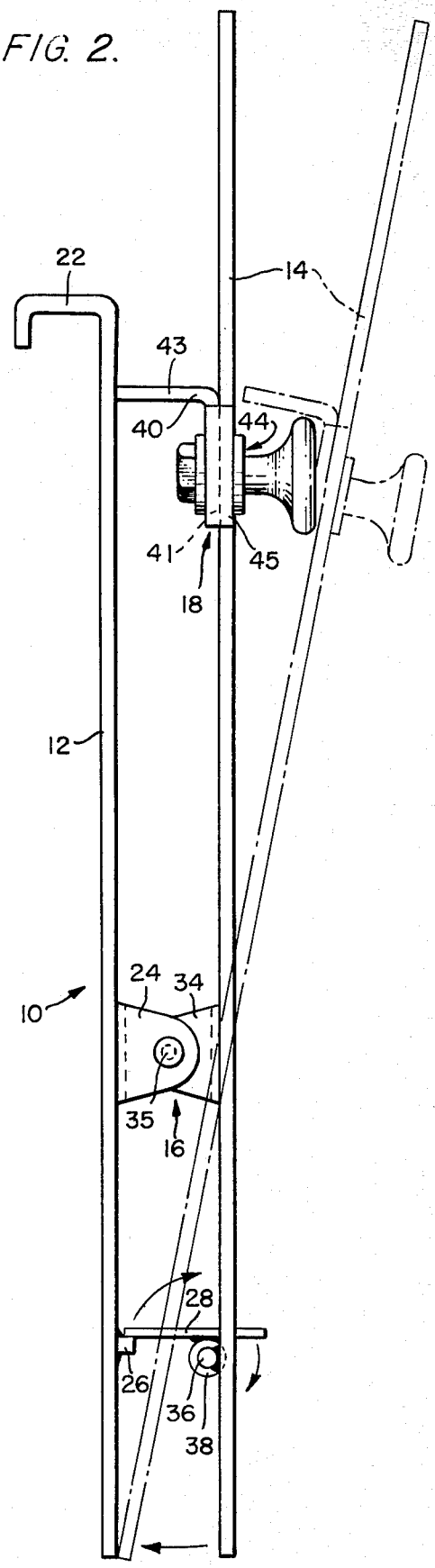
FIG. 2 is a left side view of the weather board clamping device according to the present invention, illustrating particularly the device in both the closed (solid lines) and open (phanton lines) positions.

As shown in FIGS. 1 and 2, the weather board clamping device of the present invention is indicated by reference numeral 10. The weather board clamping device 10 generally comprises a first long, substantially flat member 12, a second, long, flat member 14, a hinge 16, and an adjustable bracket or clip 18.

In the preferred embodiment, the first member 12 and the second member 14 are usually positioned vertically along the wall of a building, and opposite to each other. Further, the second member 14 is preferably longer than the first member 12, although this is not absolutely necessary. Further, the first member 12 and the second member 14 are preferably made of a rigid material, e.g., metal or plastic.

The first member 12 terminates at its top in a "hook" 22, which is capable of fitting over the top and both upper sides of a weather board 11 already secured to the wall of a building. Just below the mid-point of the first member 12 there is positioned a first hinge member 24 of a hinge 16. Near the bottom of the first member 12 there is attached, e.g., by welding, a stop 26, which has normally abutting thereupon a rectangular guide 28 (to be described more fully hereafter) which is rotatably connected to the second member 14.

Figure 3:
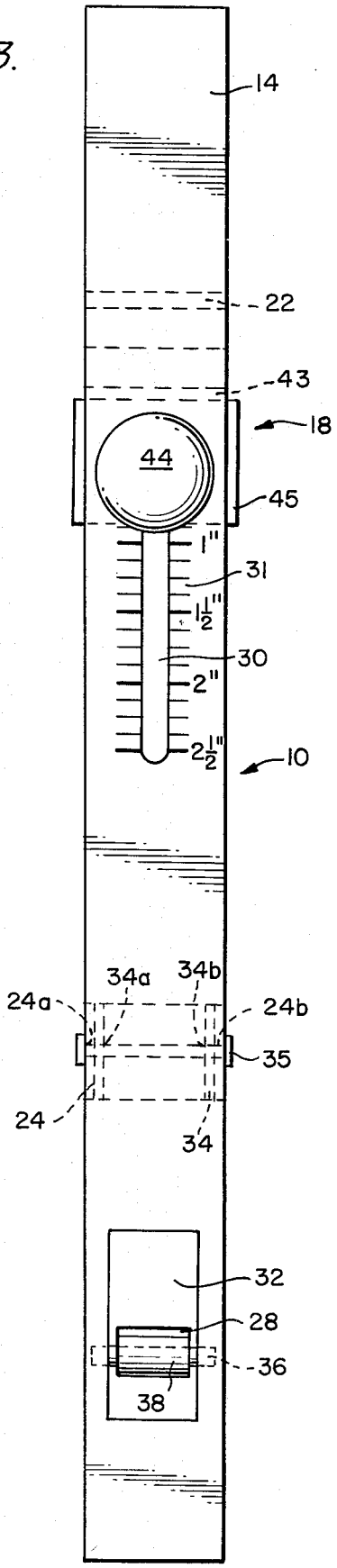
FIG. 3 is a front view of the weather board clamping device of the present invention, illustrating particularly the gauge used with the adjustable slider.
Figure 4:
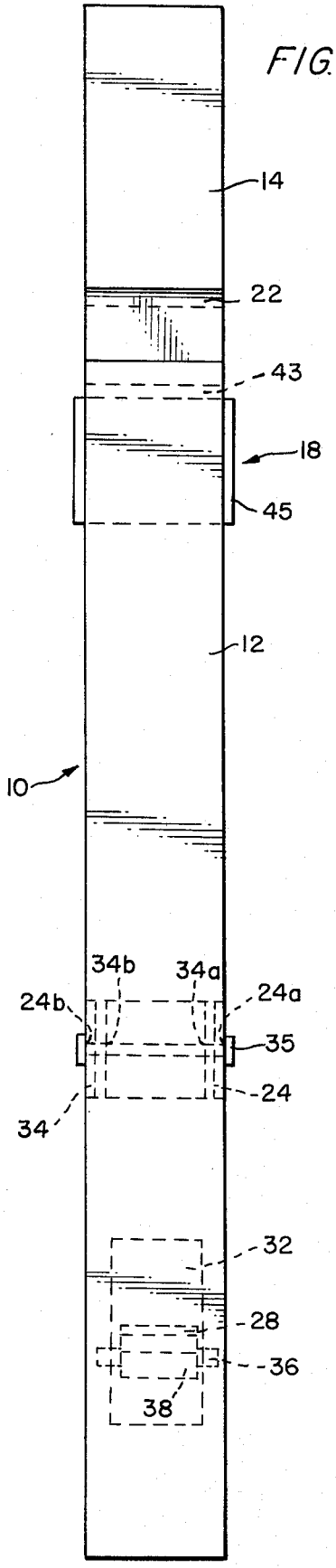
FIG. 4 is a rear view of the weather board clamping device of the present invention.

The second member 14 has an elongated slit 30 (see FIG. 3) formed therein near its mid-point which is parallel to the longitudinal axis of the second member 14. In addition, near the bottom of the second member 14 there is a rectangular opening 32 for receiving part of the rotatable rectangular guide 28 therethrough. Further, there is a second hinge member 34 of the hinge 16, which corresponds to the first hinge member 24 and which is located substantially below the mid-point of the second member 14. The first hinge member 24 of the hinge 16 has holes 24(*a*) and 24(*b*), and similarly the second hinge member 34 of the hinge 16 has holes 34(*a*) and 34(*b*), for receiving therethrough a pin 35 which connects the first and second hinge members 24 and 34 of the hinge 16 (see FIG. 3). Finally, there is located on the second member 14 a pin 36 (see FIG. 2) which is attached, e.g., by welding, to the second member 14. Surrounding the steel pin 36 is tubing 38 which is free to rotate about the steel pin 36. The guide 28 is attached to the tubing 38, e.g. by welding, for rotation about the pin 36.

The adjustable bracket 18 comprises an "L"-shaped member 40 having a first leg 41 positioned substantially perpendicularly to a second leg 43. The "L"-shaped member 40 is adjustably connected to the second member 14 with a knob, bolt, washer and nut combination 44 extending through slit 30 and a guide 45 substantially surrounding the first leg 41. Along slit 30 there is a guage 31 marked in one-eighth inch increments.

The end of the second leg 43 of the "L"-shaped member 40 abuts the upper, inner side of the first member 12. On the other hand, one side of the entire second leg 41 slidingly abuts the upper inner side of the second member 14.

The various relatively flat members making up this device are preferably made of $\frac{1}{8}$ inch thick galvanized steel or a plastic of equal strength.

In the preferred embodiment, the overall weather board clamping device 10 is about 11 inches long and 1 inch wide, with the first member 12 being about 9 inches long and 1 inch wide and the second member 14 being about 11 inches long and 1 inch wide. The distance between the first member 12 and the second member while in the closed position is about $\frac{3}{4}$ inch.

The end of the hook 22, which extends downwardly when the device is oriented in the vertical plane, is about $\frac{3}{8}$ inch long. The hook 22 is about $\frac{1}{2}$ inch across.

The distance between the hinge 16 and the bottom of the first member 12 or the second member 14 is approximately 3 and $\frac{5}{8}$ inch. The first and second hinge members 24 and 34, each are about $\frac{1}{2}$ inch wide and $\frac{1}{2}$ inch long and the pin 35 connecting the two hinge members 24 and 34 is $\frac{1}{8}$ inch in diameter and about 1 inch long.

The "L"-shaped member's second leg 43 is about $\frac{3}{4}$ inch long and 1 inch wide, whereas the first leg 41 is about 1 inch long and 1 and $\frac{1}{8}$ inch wide. The knob, bolt, washer and nut combination 44 uses a cabinet drawer type knob, a $\frac{1}{8}$ inch hex bolt, a lock washer and a nut. The size of the slit 30 is about 2 and $\frac{1}{2}$ inch long and 3/16 inch wide, whereas the size of the opening 32 is about 1 and $\frac{1}{2}$ inch long and about $\frac{5}{8}$ inch wide.

The distance between the guide 28 when the device is in the vertical position and the guide 28 is not rotated, and the bottom of either the first or second member 12 or 14, respectively, is about 1 and $\frac{1}{2}$ inch. The length of the guide 28 is about 1 inch long so that about $\frac{1}{4}$ inch extends out of the second member 14. The tubing 38 is $\frac{1}{4}$ inch in diameter and $\frac{1}{2}$ inch long. The pin 36 is $\frac{1}{8}$ inch in diameter and $\frac{7}{8}$ inch long. The dimensions of the stop 26 are $\frac{1}{8}$ inch high, by $\frac{1}{8}$ inch wide, by $\frac{1}{2}$ inch long.

In operation, the weather board clamping device of the present invention enables one carpenter to install siding on a building without the aid of another carpenter. This is accomplished by a single carpenter simply hooking the hook 22 of the first member 12 of the device over the top and upper sides of a board 11 which is already nailed to a building. The carpenter then sets the adjustable bracket 18 to a preferred board overlap dimension by loosening the knob, bolt, washer and nut combination 44 and moving the "L"-shaped member 40 the preferred distance up or down the second member 14, and then securing the combination 44. Then the carpenter places another device 10 similar to the device 10 described above on the other end of the board 11 and adjusts it to the same board overlap dimension.

The bottom of a new board 13 is positioned in and supported by the two spaced devices 10 on the respective second legs 43 of the "L"-shaped members 40 and the new board 13 is nailed in place on the building.

Once this new board 13 is nailed, the end of the rotatable guide 28 extending out of the second member 14 of one of the devices 10 is pushed downwardly by the carpenter to rotate it in a clockwise direction (using FIG. 2 as a reference). At the same time the knob of combination 44 is pulled by the carpenter in a direction away from the building. The simultaneous pushing of the guide 28 and pulling of the knob of combination 44 allows the bottom of the second member 14 to move toward the bottom of the first member 12, and allows the top of the second member 14 to move away from the top of the first member 12. In effect, the second member 14 is positioned at an acute angle relative to the first member 12.

Of course, as the top of the second member 14 moves away from the top of the first member 12, the second leg 43 of the "L"-shaped member 40 leaves its supporting relation with the bottom of the newly secured board. With the second leg 43 of the "L"-shaped member 40 cleared from the bottom of the newly nailed board 13 the device 10 may be removed from the building wall. To do this, the device 10 is merely moved at first upwardly enough to remove the hook 22 from the top of board 11 and then downwardly and out from under the newly secured board 13. The second device 10 of the pair used is similarly removed.

Then the hook 22 of the first member 12 of each of the pair of devices 10 may be spatially positioned on the newly secured board 13 so that another new board 15 (not shown) may be supported thereon and nailed, as outlined above, and so on.

This tool will not only save money on labor by allowing one carpenter to quickly and easily perform the work, but will accurately maintain the board overlap dimension the carpenter chooses.

The foregoing is considered as illustrative only of the principles of the invention. Further, since numerous modifications and changes will readily occur to those skilled in the art, it is not desired to limit the invention to the exact construction and operation shown and described; accordingly, all suitable modifications and equivalents may be resorted to, falling within the scope of the invention and the appended claims and their equivalents.

I claim:

1. A tool for applying pieces of siding to a building, comprising:

(a) a first long, substantially flat member for flushly engaging a first piece of siding nailed to a building, the first member terminating in a hook extending over the first piece of siding;

(b) a second, substantially flat member normally positioned substantially parallel to the first member, the second member having (i) a slit located therein, (ii) a bracket means adjustably connected thereto, the bracket being an "L"-shaped member with a first leg perpendicular to a second leg, the first leg temporarily abutting the first member and temporarily supporting a second piece of siding, and the second leg slidingly abutting the second member, and (iii) means for adjustably securing the "L"-shaped member to the second member, the securing means extending through the slit in the second member; and (c) means for hingedly connecting the second member to the first member, wherein once the second piece of siding is nailed, the second member is rotatable on the hinge means relative to the first member such that the bracket means no longer abuts the first member or supports the second piece of siding and the first member may be removed from engagement with the first piece of siding.

2. The tool recited in claim 1, further comprising:

(a) a rectangular opening located in the second member and (b) a flat, rectangular guide having a first end and a second end, the first end temporarily abutting the first member and the second end extending through the rectangular opening and being roatably connected to the second member, wherein rotation of the first end directly toward the second member allows the second member to rotate relative to the first member.

3. The tool recited in claim 2, wherein the adjustable bracket means further comprises:

a guage marked in increments of measurement along the slit located in the second member.

4. A tool for applying pieces of siding to a building, comprising:

(a) a first long, substantially flat member for flushly engaging a first piece of siding nailed to a building, the first member terminating in a hook extending over the first piece of siding;

(b) a second long, flat member normally positioned substantially parallel to the first member for engaging a second unnailed piece of siding, the second member having a slit therein marked in increments of measurement along the slit, and rectangular opening positioned therein opposite the end closest to the hook of the first member;

(c) means for hingedly connecting the second member to the first member;

(d) a bracket adjustably connected to the second member, the bracket having an "L"-shaped member with a first leg perpendicular to a second leg, the first leg temporarily abutting the first member and the second leg being positioned in sliding abutting relation with the second member and temporarily supporting the second piece of siding, and securing means extending through the slit for adjustably connecting the "L"-shaped member to the second member; and (e) a flat, rectangular guide having a first end and a second end, the first end temporarily abutting the first member and the second end extending through the opening and being rotatably connected to the second member, wherein once the second board is nailed, rotation of the first end of the guide directly toward the second member allows the second member to rotate on the hinge means relative to the first member such that the second member no longer engages the second piece of siding, the bracket no longer abuts the first member or supports the second piece of siding and the first member may be removed from engagement with the first piece of siding.

* * * * *